US005980359A

United States Patent [19]

Brown

[11] Patent Number: 5,980,359

[45] Date of Patent: Nov. 9, 1999

[54] BRA BARRIER DEVICE

[76] Inventor: Norma Brown, 2721 Kings Hwy., apt. 4M, Brooklyn, N.Y. 11229

[21] Appl. No.: 08/996,335

[22] Filed: Dec. 22, 1997

[51] Int. Cl.[6] ..... A41C 3/10

[52] U.S. Cl. ..... 450/57; 450/4.6; 450/23; 450/60; 450/62; 450/14-16; 450/53; 450/80; 450/59

[58] Field of Search ..... 450/4, 6, 23, 60, 450/62, 14–16, 53, 80, 59

[56] References Cited

U.S. PATENT DOCUMENTS

| | | | |
|---|---|---|---|
| 609,434 | 8/1898 | Howe . | |
| 723,893 | 3/1903 | Meyer . | |
| 2,616,083 | 11/1952 | Salim Sade El Juri | 450/53 |
| 3,301,259 | 1/1967 | McLeod . | |
| 5,060,648 | 10/1991 | Zarkesh . | |
| 5,183,460 | 2/1993 | Scherz | 602/79 |
| 5,603,653 | 2/1997 | Hartman . | |
| 5,716,255 | 2/1998 | Abercrombie et al. | 450/60 |

FOREIGN PATENT DOCUMENTS

| | | | |
|---|---|---|---|
| 2253333 | 9/1992 | United Kingdom | 450/62 |

OTHER PUBLICATIONS

Gershman, Maurice, "Self Adhering Nylon Tapes." J.A.M.A., vol. 168, No. 7, p. 930, Oct. 1958.

*Primary Examiner*—Gloria Hale
*Attorney, Agent, or Firm*—Michael I. Kroll

[57] ABSTRACT

A bra barrier device (16) comprising a flexible, substantially flat absorptive protective band (18) worn on an abdomen (20) of a woman's body (22). A top edge (24) of the band (18) extends under the breasts (26) and a lower border (28) at the cups (30) of a bra (32), so as to prevent dermal irritation and lesions caused by heat, moisture and chaffing associated with use of the bra (32).

3 Claims, 6 Drawing Sheets

Fig. 7
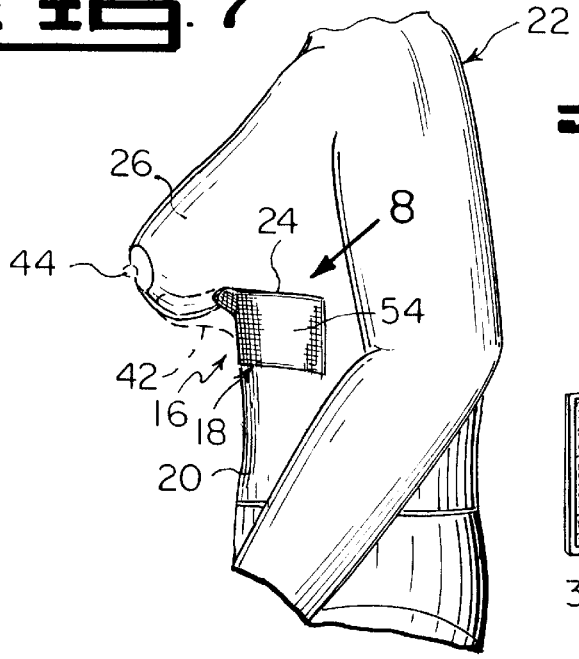
Fig. 8
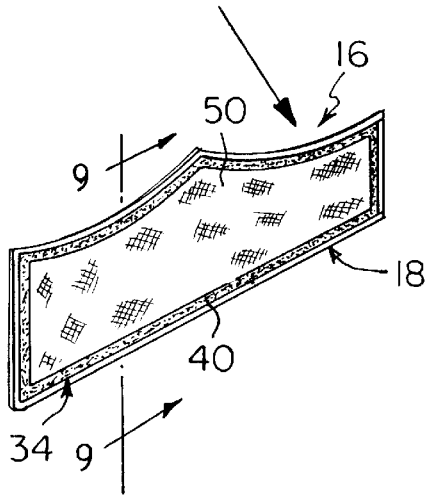
Fig. 9
Fig. 10
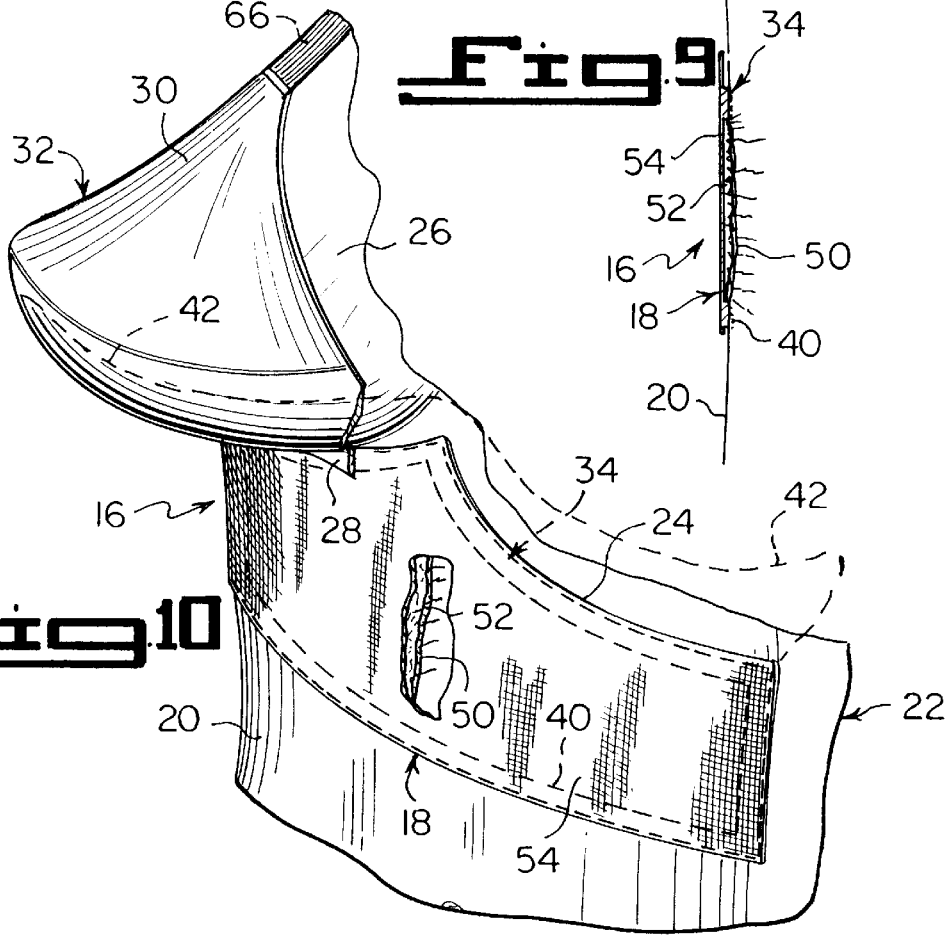

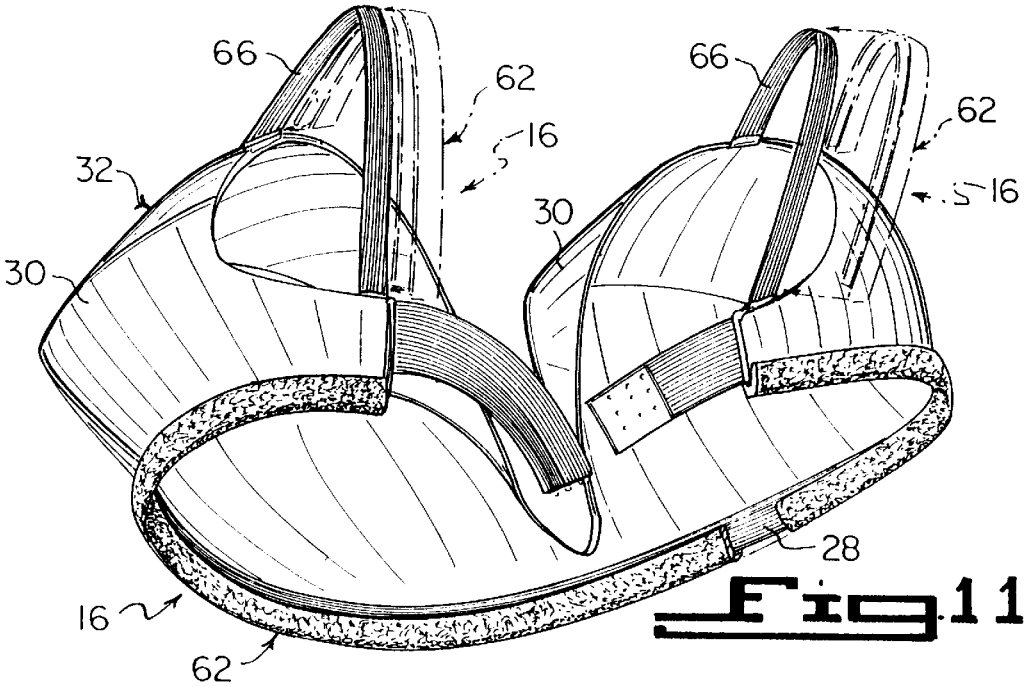
Fig. 11
Fig. 12
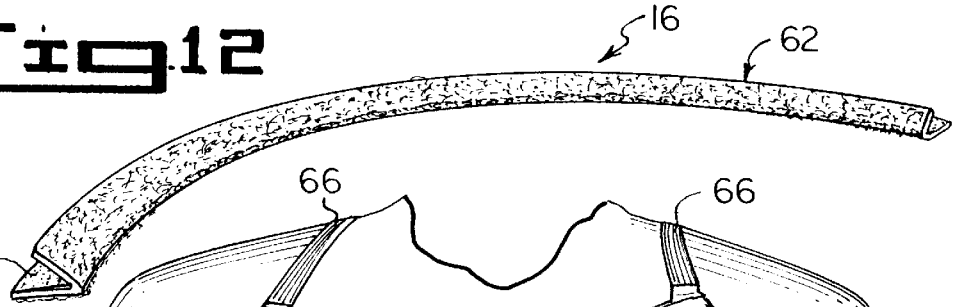
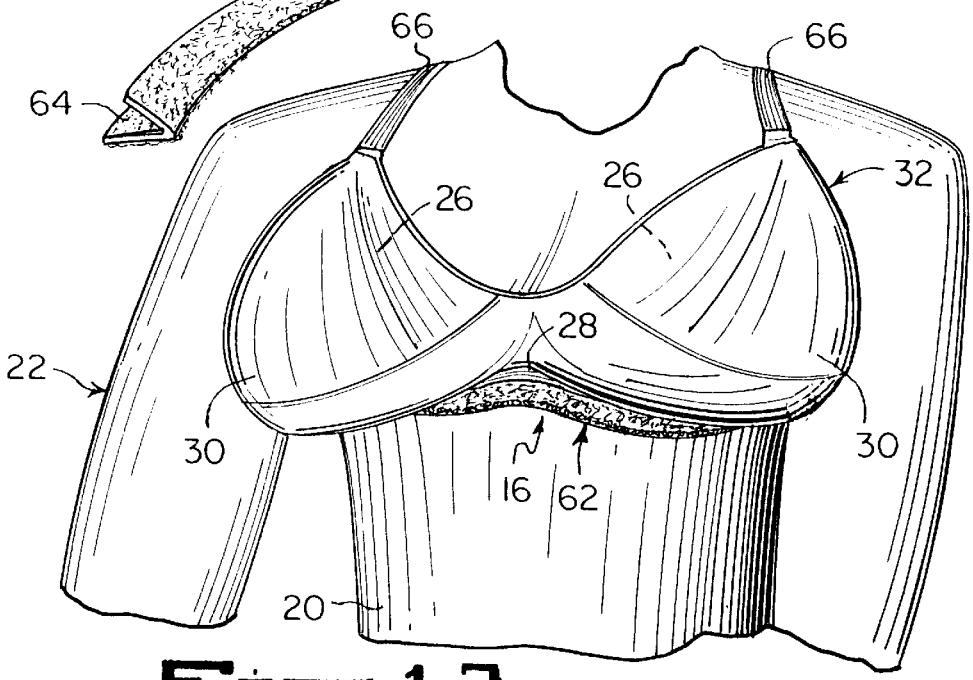
Fig. 13

BRA BARRIER DEVICE

BACKGROUND OF THE INVENTION

1. Field of the Invention

The instant invention relates generally to female body undergarments and more specifically it relates to a bra barrier device. The bra barrier device is made for a woman to be worn with a bra. It soothes irritated skin, can treat irritation, acts as a barrier against abrasive material and absorbs perspiration. It can be made inexpensively by containing recycled paper material, while it is easy and convenient to use. Since the product can consist of paper and adhesive strips, a woman could customize it by using a pair of scissors to shape it.

2. Description of the Prior Art

Numerous female body undergarments have been provided in prior art. For example, U.S. Pat. Nos. 609,434 to Howe; 723,893 to Meyer; 3,301,259 to McLeod; 5,060,648 to Zarkesh and 5,603,653 to Hartman all are illustrative of such prior art. While these units may be suitable for the particular purpose to which they address, they would not be as suitable for the purposes of the present invention as heretofore described.

HOWE, ELEANOR EUDORA

COREST

U.S. Pat. No. 609,434

A corset, the opposite sides of which are provided with detachable belts or straps. The ends of the belts or straps adjacent to the body of the corset being widened approximately as wide as the corset. The straps or belts being provided at the free ends thereof with means for connecting the same. The upper and lower extended portions at the inner ends of the straps adjacent to the body portion of the corset being stiffened with transverse stays. The body portions of the belts or straps adjacent to the wider ends being also provided with transverse stays, substantially as shown and described.

MEYER, SOPHIE

CORSET

U.S. Pat. No. 723,893

A corset having at its upper front edge a pair of breast-supports, the broad faces of which are substantially horizontal.

McLEOD, JOSEPHINE C.

BODY SUPPORTING UNDERGARMENT

U.S. Pat. No. 3,301,259

In an undergarment of the character described, a bodice adapted to provide breast and abdominal support formed of serially interconnected elastic and inelastic panels. Front, back and side panels are contoured and dimensioned to provide a narrow waist section and a highly elastic body-girdling abdominal portion of relatively substantial length. Separable fastening means are incorporated between two of the panels. Laterally spaced apart breast cups at the top of the front panel being attached thereto at concavely arcuate joints. Relatively inflexible stiffening elements are in the joints. Vertically extending stays are in the bodice and spaced therearound. At least one of the stays extends inwardly of and over the stiffening elements and up into each of the breast cups and being constructed and arranged to keep the stiffening elements from bearing against the abdomen of the wearer.

ZARKESH, SHAHLA

BREAST BINDER

U.S. Pat. No. 5,060,648

A breast binder for supporting the breast during breast engorgement. It would be worn after child deliver, basically by mothers who do not intend to breast feed their babies, to help treat the pain caused by breast engorgement.

EARTMAN, KATHIE F.

PERSPIRATION ABSORBENT PADS FOR FEMALE BREASTS

U.S. Pat. No. 5,603,653

Various embodiments of perspiration absorbent pads for female breasts are provided, which are particularly adapted for placement between the overlying breast and the adjacent surface of the chest to preclude skin-to-skin contact and to absorb perspiration in that area. The pads may comprise generally cylindrical absorbent devices, having either random fiber or other fill material therein or a rolled sheet of absorbent material. Such cylindrically shaped pads provide for moisture absorption and also provide some uplifting of the breast to produce the appearance of a fuller bust line. Other embodiments comprise a relatively thin and flat pad, having a non-slip outer sheet of material, a moisture impervious layer, a thin moisture absorbent layer, and another layer to transfer moisture to the moisture absorbent layer. The relatively thin pads may also include a relatively thicker portion similar to the cylindrical pads, to provide greater absorption properties and uplift. Some of the pad embodiments are particularly adapted to be retained between the breast and adjacent chest, depending upon the fullness of the breast, and require no adhesives or other form of retention to remain in place. Others provide for attachment to the inner surface of the lower portion of a brassiere cup, to absorb perspiration emanating from the lower front portion of the breast. Any of the pad embodiments may be formed of reusable or economically disposable materials, as desired.

SUMMARY OF THE INVENTION

Many women often experience skin rashes and lesions caused by the chafing of their bras, perspiration and heat combined. This device is an absorptive, protective, barrier layer worn as an insert between the bra and skin. This layer of soft absorptive material cushions and soothes irritated skin, wicks away perspiration, and acts as a barrier layer preventing abrading from the lower border of the bra.

It could have a therapeutic function by providing medication to affected areas if it's fibers are impregnated with substances like aloe or zinc oxide. Some type of paper material is envisioned, similar to diaper filler. Application of this barrier layer could be done with the utilization of adhesive strips or VELCRO. This device seeks to protect skin areas under the breast and in one ramification, between the breasts.

The bra barrier device is a full barrier insert worn with a bra, affixed to the lower border of the bra and lower aspect of the cup with adhesive strips. The insert extends from the undersurface of the breast to two to three inches below the bra. Additional adhesive strips are optional.

A primary object of the present invention is to provide a bra barrier device that will overcome the shortcomings of the prior art devices.

Another object is to provide a bra barrier device that will prevent dermal irritation and lesions caused by heat, moisture and chafing associated with the use of a bra.

An additional object is to provide a bra barrier device that seeks to sooth, protect and medicate skin areas about the female breast which have already been affected and irritated.

A further object is to provide a bra barrier device that is simple and easy to use.

A still further object is to provide a bra barrier device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 1:
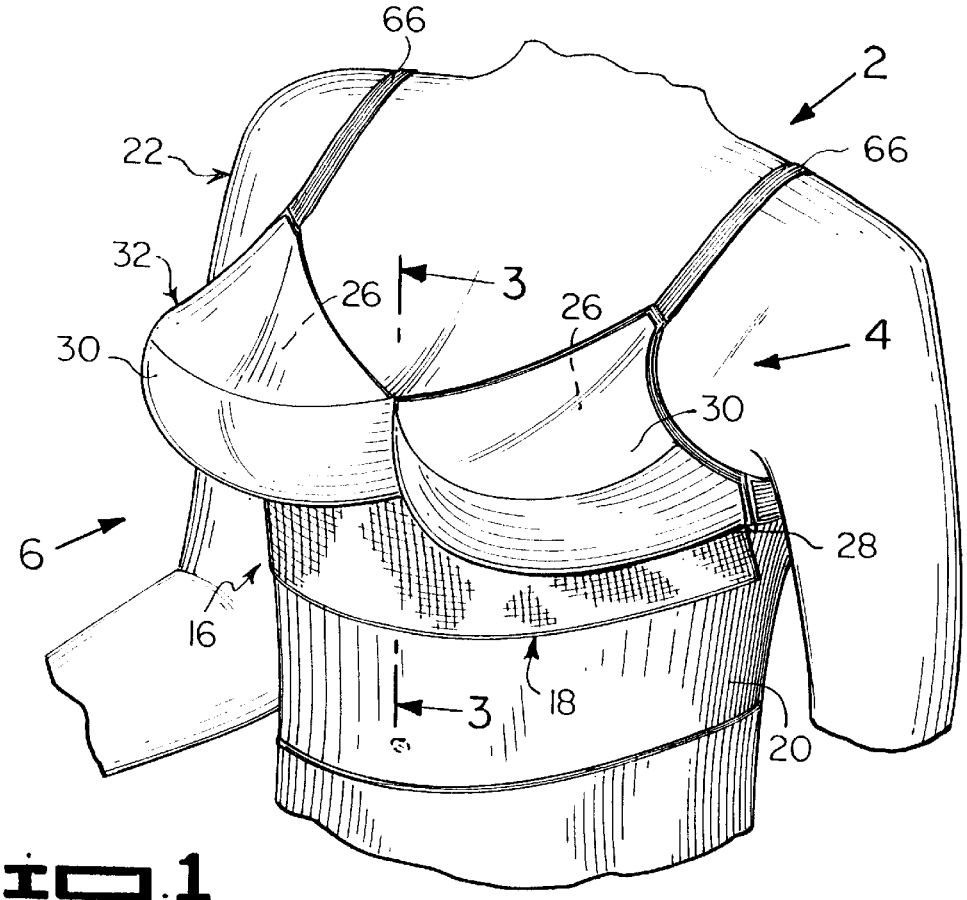
FIG. 1 is a front perspective view of a first embodiment of the present invention worn on an abdomen of a woman's body, extending under the breasts and a lower border of the cups of a bra.
Figure 6:
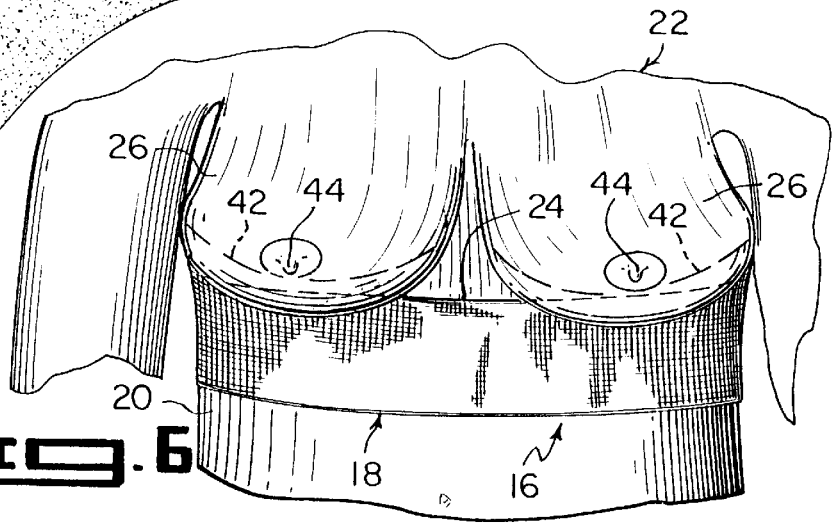
FIG. 6 is a front elevational view taken in the direction of arrow 6 in FIG. 1, with the bra removed from the woman's body.
Figure 6A:
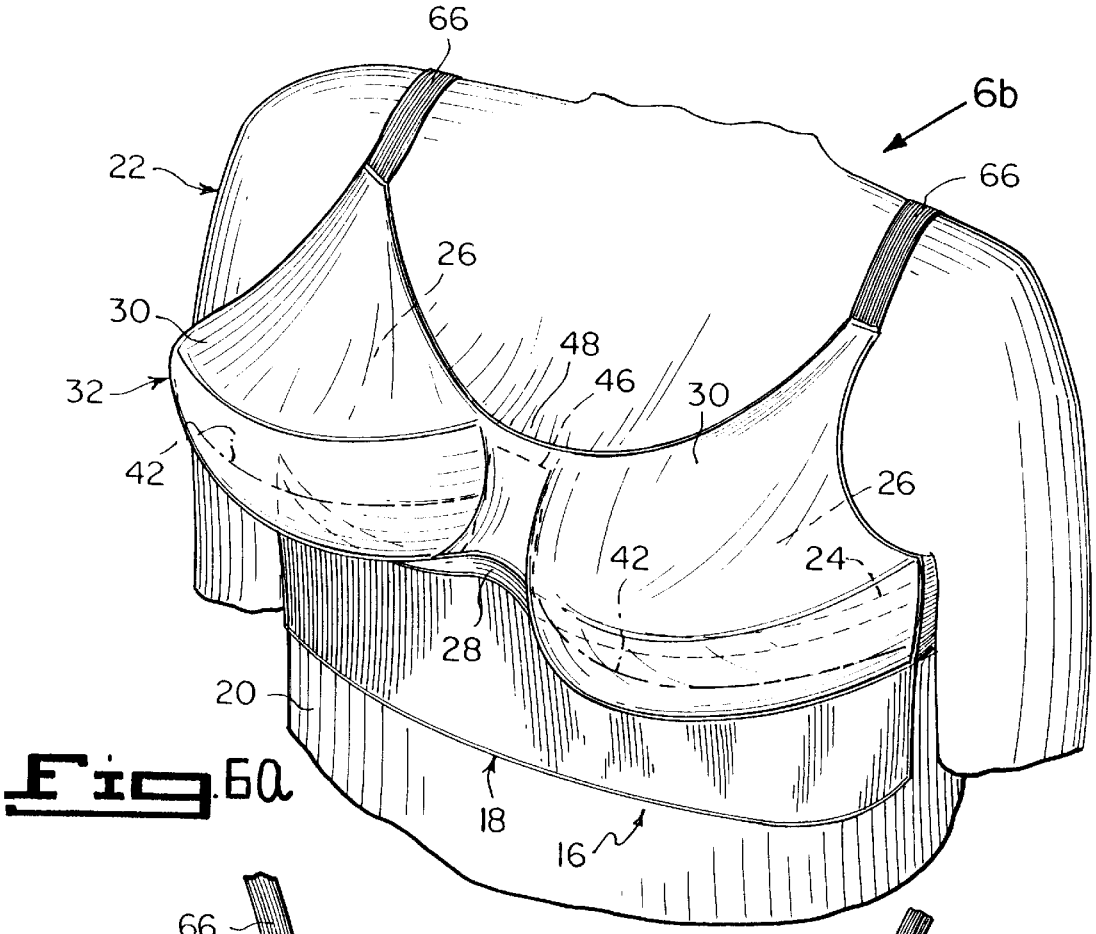

FIG. 6*a* is a front perspective view, similar to FIG. 1, showing a second embodiment of the present invention.

Figure 2:
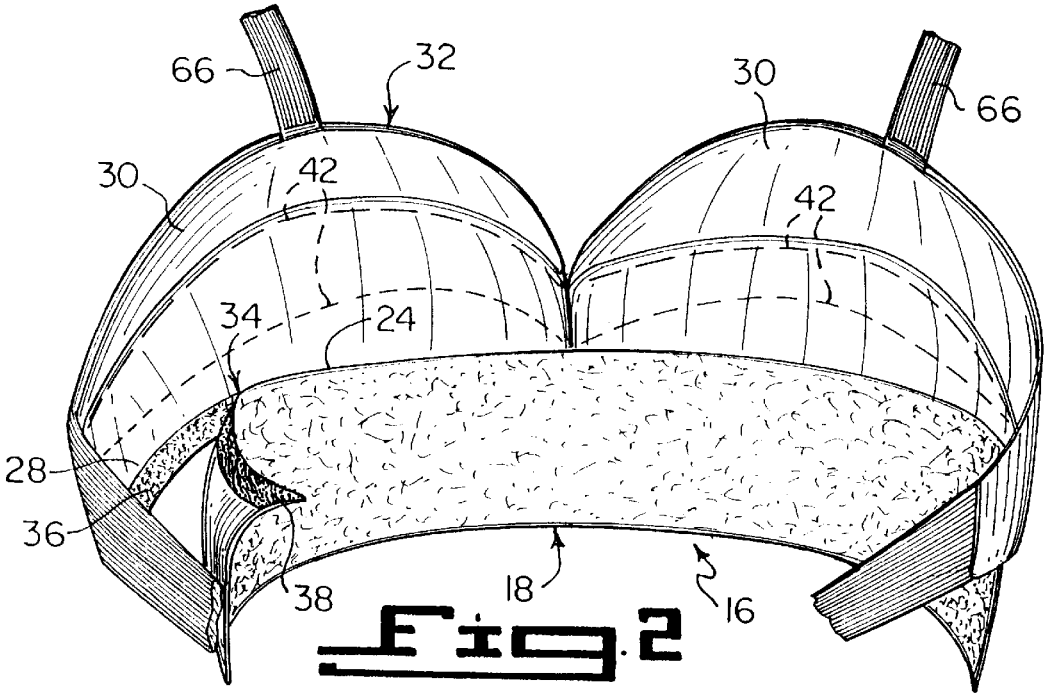
FIG. 2 is a rear perspective view taken in the direction of arrow 2 in FIG. 1, with parts of the bra broken away and the woman's body removed therefrom.
Figure 6B:
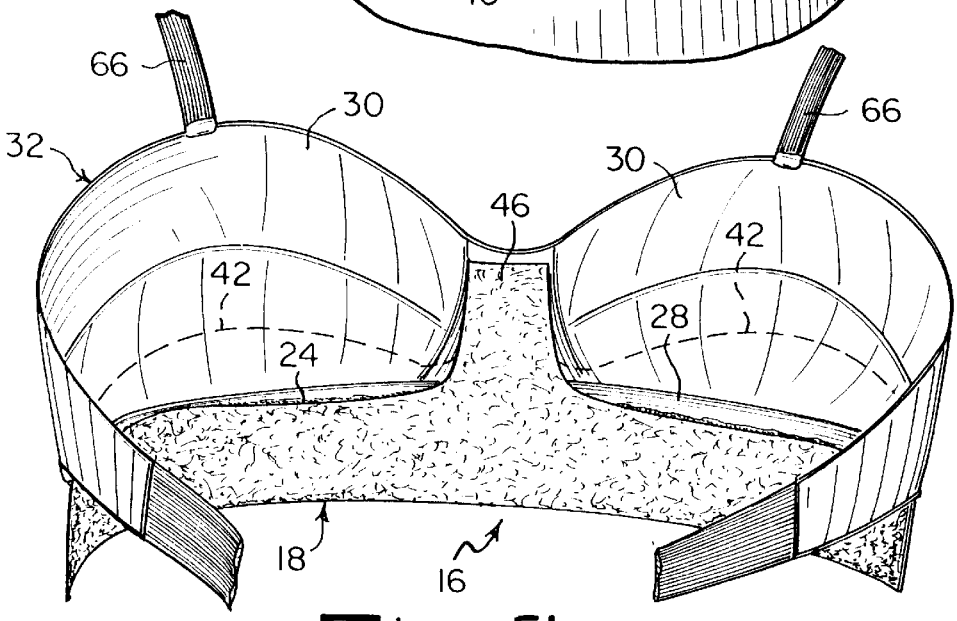

FIG. 6*b* is a rear perspective view, similar to FIG. 2, taken in the direction of arrow 6*b* in FIG. 6*a*.

FIG. 7 is a side elevational view of a third embodiment of the present invention worn on the abdomen of the woman's body under the breast with the bra removed therefrom.

FIG. 8 is a rear perspective view of the third embodiment per se, taken in the direction of arrow 8 in FIG. 7, shown in a flat straight position.

FIG. 9 is a cross sectional view taken along line 9—9 in FIG. 8.

FIG. 10 is a side perspective view of the third embodiment worn on the abdomen of the woman's body under the breasts and the lower border at the cups of the bra, with parts broken away and in section.

FIG. 11 is a bottom rear perspective view of the bra, showing a fourth embodiment of the present invention attached about the lower border and the shoulder straps thereof.

FIG. 12 is a perspective view of the fourth embodiment per se.

FIG. 13 is a front elevational view, showing the fourth embodiment attached about the lower border of the bra worn on the woman's body.

Figure 14:
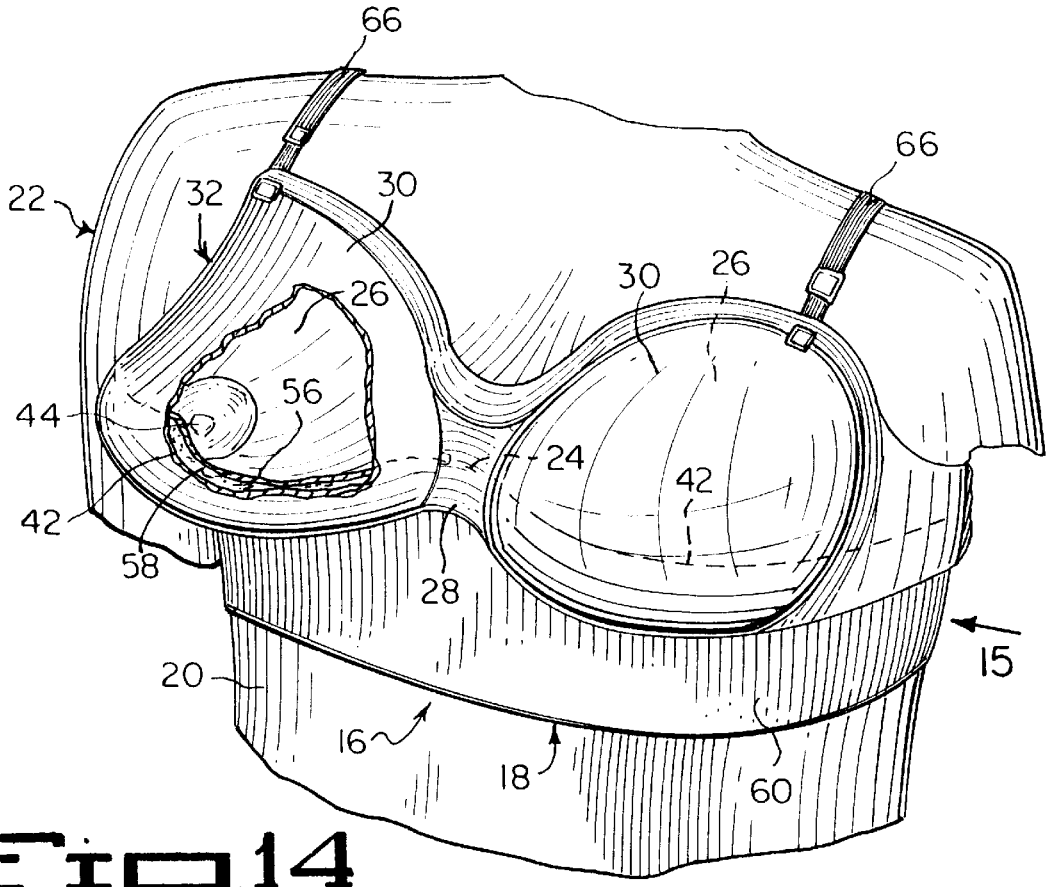

FIG. 14 is a front perspective view, similar to FIG. 6*a*, showing a fifth embodiment of the present invention, with parts broken away and in section.

Figure 15:
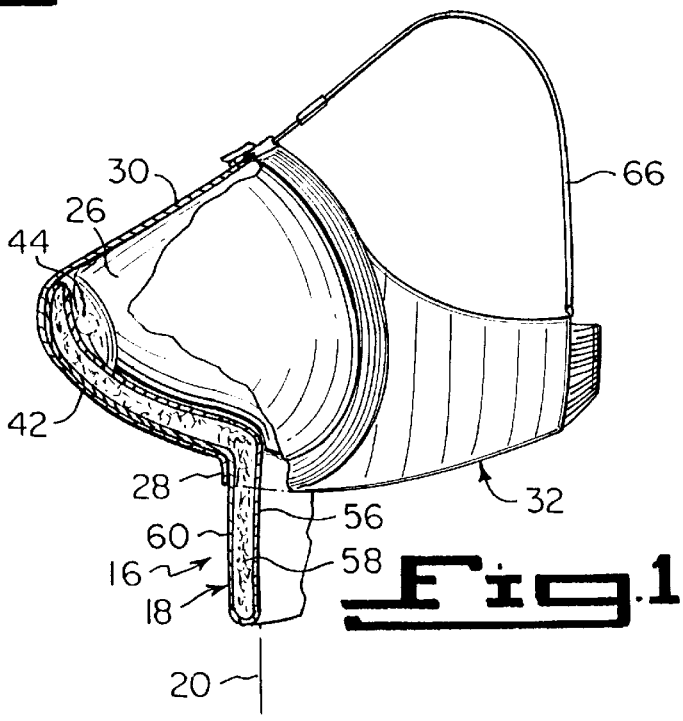

FIG. 15 is a side elevational view taken in the direction of arrow 15 in FIG. 14, with parts broken away and in section.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 15 illustrate the present invention being a bra barrier device 16. With regard to the reference numerals used, the following numbering is used throughout the various drawing figures.

| | |
|---|---|
| 16 | bra barrier device |
| 18 | band of 16 |
| 20 | abdomen of 22 |
| 22 | woman's body |
| 24 | top edge of 18 |
| 26 | breast of 22 |
| 28 | lower border of 32 |
| 30 | cup of 32 |
| 32 | bra |
| 34 | removable maintaining structure of 16 |
| 36 | first VELCRO strip of 34 on 28 |
| 38 | second VELCRO strip of 34 on 18 |
| 40 | adhesive of 34 on 18 |
| 42 | extendable section of 18 |
| 44 | nipple of 26 |
| 46 | central partition of 18 |
| 48 | cleavage area between 26 |
| 50 | porous inner layer of 18 |
| 52 | medicated middle layer of 18 |
| 54 | nonporous outer layer of 18 |
| 56 | porous inner layer of 18 |
| 58 | absorptive padded middle layer of 18 |
| 60 | nonporous outer layer of 18 |
| 62 | wraparound strip for 16 |
| 64 | adhesive on 62 |
| 66 | shoulder strap of 32 |

The bra barrier device 16 as shown in FIGS. 1 through 10, 14 and 15, comprises a flexible, substantially flat absorptive protective band 18 worn on an abdomen 20 of a woman's body 22. A top edge 24 of the band 18 extends under the breasts 26 and a lower border 28 at the cups 30 of a bra 32, so as to prevent dermal irritation and lesions caused by heat, moisture and chaffing associated with use of the bra 32.

Figure 3:
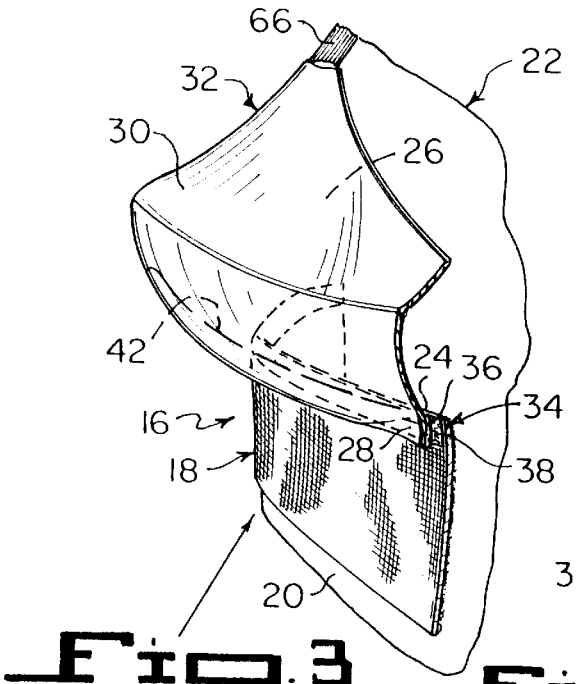
FIG. 3 is a cross sectional perspective view taken along line 3—3 in FIG. 1.
Figure 4:
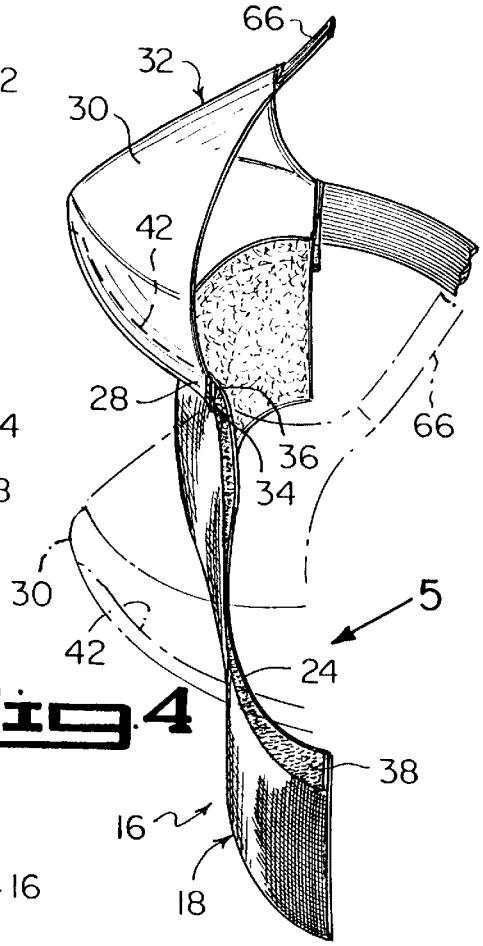
FIG. 4 is a side perspective view taken in the direction of arrow 4 in FIG. 1, with parts of the bra broken away and in phantom, with the woman's body removed therefrom.

A structure 34 is for maintaining the band 18 in a removable manner in position on the abdomen 20 on the woman's body 22. The removable maintaining structure 34, as best seen in FIGS. 2, 3 and 4, includes two VELCRO strips 36 and 38. The first VELCRO strip 36 is applied onto an inner surface of the lower border 28 at the cups 30 of the bra 32. The second VELCRO strip 38 is applied onto an outer surface of the band 18 adjacent the top edge 24. When the two VELCRO strips 36 and 38 mate together, the band 18 will be held in position on the abdomen 20 of the woman's body 22.

Figure 5:
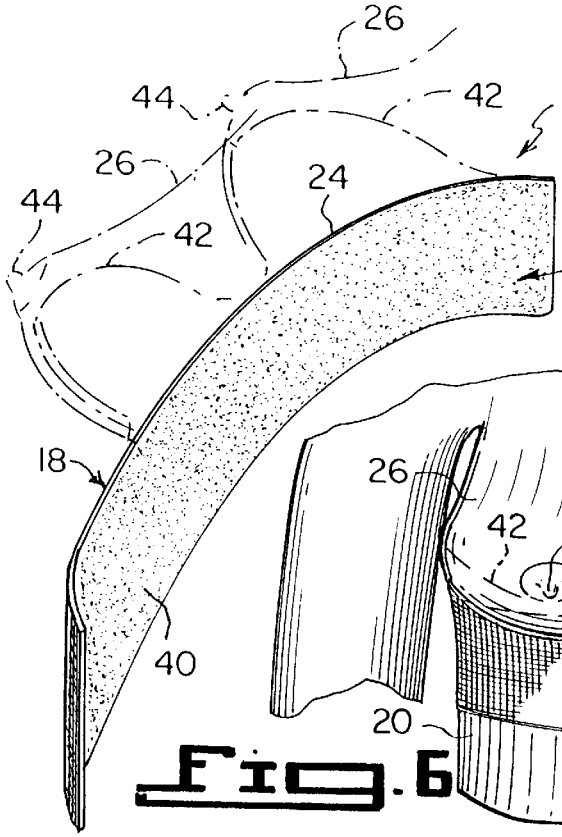
FIG. 5 is a rear perspective view taken in the direction of arrow 5 in FIG. 4, with the bra removed therefrom and the woman's breasts shown in phantom.

The removable maintaining structure 34, as best seen in FIGS. 5 and 8, is adhesive 40 applied onto an inner surface of the band 18. When the band 18 is pressed against the abdomen 20 of the woman's body 22, the adhesive 40 will stick thereto.

The band 18 can contain two extendable sections 42 integral with the top edge 24, to protect the breasts 26 up to the nipples 44. The band 18 can also contain a central partition 46, as shown in FIGS. 6*a* and 6*b*, integral with the top edge 24, which extends up into a cleavage area 48 between the breasts 26 to offer additional protection between the breasts 26.

The band 18 in FIGS. 7 through 10, includes a porous inner layer 50, a medicated middle layer 52 and a nonporous outer layer 54. When the porous inner layer 50 is placed against the skin on the abdomen 20 of the woman's body 22, the medicated middle layer 52 will release medication to the skin.

The band 18, as shown in FIGS. 14 and 15, includes a porous inner layer 56, an absorptive padded middle layer 58 and a nonporous outer layer 60. When the porous inner layer 56 is placed against the skin on the abdomen 20 up to the nipples 44, the absorptive padded inner layer 58 will help uplift the breasts 26 within the cups 30 of the bra 32.

FIGS. 11 through 13 show the bra barrier device 16 comprising a flexible, substantially flat absorptive protective wraparound strip 62. Adhesive 64 is on an inner surface of the wraparound strip 62. When the wraparound strip 62 is folded longitudinally and inwardly to a V-shaped configuration, the inner surface with the adhesive 64 can engage with the lower border 28 at the cups 30 of the bra 32, so as to prevent dermal irritation and lesions caused by heat, moisture and chaffing associated with use of the bra 32. When the wraparound strip 62 is folded longitudinally and inwardly to the V-shaped configuration, the inner surface with the adhesive 64 can engage with a shoulder strap 66 of the bra 32, so as to prevent dermal irritation and lesions caused by the heat, moisture and chaffing associated with use of the bra 32.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bra barrier device comprising:

a) a flexible, substantially flat absorptive protective band worn on an abdomen of a woman's body, with a top edge of said band folded over away from said abdomen and extending under the breasts and the cups of said bra;

b) means for engaging the outside of the folded portion of said band with the bottom edge of the cups of said bra; and c) said engaging means comprising mating hook and loop fastener strips on the folded portion of said band and said bottom edge of the cups of said bra.

2. A carrier device for and in combination with a bra, said bra having a pair of cups with a lower border and shoulder straps, comprising:

a) a flexible, substantially flat absorptive protective wraparound strip folded to form a lengthwise V-shape;

b) adhesive on an inner surface of said wraparound strip, said inner surface engaged with said lower border and one end of each of said shoulder straps, so as to prevent dermal irritation and lesions caused by heat, moisture and chaffing associated with use of the bra.

3. A bra barrier device comprising:

a) a flexible, substantially flat absorptive protective wraparound strip;

b) adhesive on an inner surface of said wraparound strip for holding said strip on an abdomen; and c) the top edge of said strip being folded over so as to engage and adhere to a lower border of the cups of a bra.

* * * * *